United States Patent [19]

Henry, Jr.

[11] 4,399,982

[45] Aug. 23, 1983

[54] HEAVY PETROLEUM OIL PLASTICIZED, TAR BONDED TAPHOLE MIX

[75] Inventor: Francis W. Henry, Jr., Glen Burnie, Md.

[73] Assignee: General Refractories Company, Bala Cynwyd, Pa.

[21] Appl. No.: 330,507

[22] Filed: Dec. 14, 1981

Related U.S. Application Data

[62] Division of Ser. No. 144,439, Apr. 28, 1981, abandoned.

[51] Int. Cl.[3] ..... C21B 7/12

[52] U.S. Cl. ..... 266/45; 266/270; 266/271

[58] Field of Search ..... 266/45, 270, 271

[56] References Cited

U.S. PATENT DOCUMENTS 4,010,936 3/1977 Takashima ..... 266/45

*Primary Examiner*—P. D. Rosenberg

*Attorney, Agent, or Firm*—Brian G. Brunsvold; Charles E. Lipsey; Everett H. Murray

[57] ABSTRACT

A blast furnace taphole plugging composition comprising a coal tar binder, a refractory filler and a very heavy aromatic petroleum oil which fails to polymerize at the high heating rates experienced during normal application of the taphole mix to the taphole. Preferred aromatic petroleum oils useful in the present invention have a minimum boiling temperature of 700° F. and above and a boiling range between 700° F. and 1000° F. Methods of making and using such plasticized tar bonded blast furnace taphole mixes are also disclosed.

6 Claims, No Drawings

HEAVY PETROLEUM OIL PLASTICIZED, TAR BONDED TAPHOLE MIX

This is a division of application Ser. No. 144,439, filed Apr. 28, 1981 now abandoned.

BACKGROUND OF THE INVENTION

The invention relates generally to refractory compositions and more particularly to refractory compositions suitable for closing the tapholes of blast furnaces and the like.

Numerous compositions have been employed in the past for plugging blast furnace tapholes. These compositions generally comprise mixtures of a refractory filling material and a hardenable binding material. Prior art taphole mix compositions occasionally have been selected or modified in order to enhance or suppress one or more properties of the mix including the rate of hardening of the mix, the flowability of the mix or the nature of fumes given off during curing of the mix. Thus, it has been known in the past to employ natural binding materials, such as coal tar, synthetic resinous binding materials and mixtures thereof. It has also been known in the prior art to add various materials such as wetting agents or plasticizers to the composition.

For example, U.S. Pat. No. 4,022,739 issued May 10, 1977 to Bove discloses a composition for plugging blast furnace tapholes comprising about 70 to 85% of a mineral filler, and 15 to 30% of a hydrocarbon binder. The hydrocarbon binder consists of a thermosetting resin capable of preserving its stability at temperatures up to 200° C. (392° F.) and a hydrocarbon derivative having a temperature of initial distillation higher than 200° C. (392° F.). A secondary binder such as a pitch obtained by the distillation of tar or by the distillation of crude petroleum may also be included.

The hydrocarbon derivative employed as part of the binder in the Bove taphole mix may be (1) a non-paraffinic extract obtained by the treatment of the distillates of crude petroleum under vacuum with a selective solvent such as phenol, nitrobenzene or furfural or (2) a bituminous binder obtained by the direct distillation of crude petroleum and having an initial distillation temperature above 250° C. at normal atmospheric pressure.

The respective portions of the resin and the hydrocarbon derivative are said to be selected so as to obtain at the time of use a hardening which is more or less rapid as a function of the characteristics and operation of the blast furnace. The percentage of hydrocarbon derivative in the mixed binder system is said to vary from 15% to 95%.

U.S. Pat. No. 4,072,531 issued Feb. 7, 1978 to Funabiki et al. also discloses a plugging composition for blast furnace tapholes comprising a refractory filler, a lignin-modified phenolic resin binder and a wetting agent such as ethylene glycol, diethylene glycol, propylene glycol, polyethylene glycol or plasticizers, such as dioctylphthalate or tricresyl phosphate, and the like. The wetting agent is added in an amount sufficient to form a clay-like mass capable of being injected into a blast furnace taphole by means of a "mud gun" or similar apparatus and typically is present in amounts from about 0.5 to about 20 parts by weight per 100 parts of refractory filler.

Both Bove and Funabiki et al. are representative of efforts to improve upon the coal tar binder sometimes employed in taphole mix compositions. While binders not containing coal tar may be advantageous in a number of respects, such substitutions generally have the disadvantage of higher cost of materials.

U.S. Pat. No. 2,841,502 issued July 1, 1958 to West et al. discloses a taphole mix comprising a refractory filler and thermal asphalt, the latter being defined as an oleaginous material obtained by the thermal cracking of heavy oils such as cycle oils and reduced crudes containing a high proportion of fused ring aromatics. The thermal asphalt is employed in amounts from about 2 to about 15%.

As can be seen from the foregoing, formulators of prior art taphole mix compositions have occasionally recognized the need to adjust the flowability of the mixture by the addition of materials which have a plasticizing effect on the mixture. Such plasticizing materials have also been employed in other tar bonded refractory materials. For example, U.S. Pat. No. 3,141,783 issued July 21, 1964 to Weaver discloses the use of hydrogenated hydrocarbons such as hydrogenated sperm oil to enhance the flowability and plasticity of refractory lining materials containing a refractory filler and a tar binder.

Formerly, in coal tar bonded taphole mixes designed for use in small blast furnaces, the mix had to be softened through the use of creosotes or light coal tar oils or added amounts of tar. In use, when these "soft" taphole mixes are applied to a taphole and the mud gun is held in place for 20 to 30 minutes, the mixes harden in the nozzle of the gun. This requires very careful cleaning of the nozzle after each usage to prevent serious application difficulties and, in general, leads to a higher usage rate of taphole mix.

SUMMARY OF THE INVENTION

The present invention overcomes the problems hitherto associated with the use of "soft" taphole mixes through the use, in combination with a tar bonded blast furnace taphole mix, of particular plasticizing materials. More specifically, a blast furnace taphole plugging composition is disclosed comprising a coal tar binder, a refractory filler and a very heavy aromatic petroleum oil which fails to polymerize at the high heating rates experienced during normal application of the taphole mix to the taphole. Preferred aromatic petroleum oils useful in the present invention have a minimum boiling temperature of 700° F. and above and a boiling range between 700° F. and 1000° F. Processes are disclosed for plasticizing tar bonded blast furnace taphole mixes in accordance with the present invention by the addition of such specified aromatic petroleum oils to the taphole mix composition. Processes are also disclosed for plugging blast furnace tapholes and the like in accordance with the present invention using plasticized tar bonded taphole mixes as above described.

Additional objects and advantages of the invention will be set forth in part in the description which follows, and in part will be obvious from the description, or may be learned from the practice of the invention. The objects and advantages of the invention may be realized and attained by means of the instrumentalities and combinations particularly pointed out in the appended claims.

To achieve the objects and in accordance with the purpose of the invention, as embodied and broadly described herein, a blast furnace taphole plugging composition in accordance with the present invention comprises a coal tar binder, a refractory filler and a very heavy aromatic petroleum oil which fails to polymerize at the high heating rates experienced during normal application of the taphole mix to the taphole. Particularly preferred petroleum oils have a minimum boiling temperature of 700° F. and above and a boiling range between 700° F. and 1000° F., although very heavy substituted aromatic petroleum oils which fail to polymerize under similar conditions may also be used. The petroleum oil is added to the taphole mix composition in an amount from about 5 to about 11% by weight on a tar basis.

Broadly, methods of plasticizing tar bonded blast furnace taphole plugging compositions in accordance with the present invention comprise forming a taphole plugging mix comprising a coal tar binder and a refractory filler and plasticizing the mix by the addition of a very heavy aromatic petroleum oil as above described, either prior to, during or after admixture of the coal tar binder and the other ingredients. Preferably, the plasticizing aromatic petroleum oil is employed as an additive to the coal tar mix composition followed by admixture of the plasticized tar binder with a refractory filler material.

The present invention also broadly comprehends methods of plugging a blast furnace taphole comprising introducing a blast furnace taphole plugging composition comprising a coal tar binder, a refractory filler and a very heavy aromatic petroleum oil, which fails to polymerize at the high heating rates experienced during normal application of the taphole mix to the taphole, into an apparatus suitable for applying the plugging composition to the furnace taphole; applying this taphole mix to the taphole via such apparatus; and holding such apparatus at the furnace taphole for a time sufficient to effect plugging of the taphole. Such methods avoid deleterious hardening of the mix in the mud gun or similar apparatus under conditions experienced during normal application even after 30 minute holds at the furnace taphole.

DESCRIPTION OF THE PREFERRED EMBODIMENTS

Reference will now be made in detail to the presently preferred embodiments of the invention which, together with the following example, serve to explain the principles of the invention.

A blast furnace taphole plugging composition in accordance with the present invention comprises a coal tar binder, a refractory filler and a very heavy aromatic petroleum oil which fails to polymerize at the high heating rates experienced during normal application of the taphole mix to the taphole. The aromatic petroleum oil may be derived from the distillation of a heavy crude oil stream and should be compatible with coal tar.

The term "aromatic petroleum oil" as above employed is intended to connote oils which are typically 60–70% aromatic with the balance being saturated and polar compounds. Very heavy aromatic petroleum oils suitable for the purposes of this invention are those which fail to polymerize and provide only small quantities of sensible non-binding carbon at the high heating rates experienced in normal taphole plugging operations. Thus, the oils contemplated for use in the present invention perform a true plasticizing function rather than acting as a binding material. While particularly preferred aromatic oils having these properties are those having minimum boiling temperatures of 700° F. and above and boiling ranges between 700° F. and 1000° F., substituted aromatic oils with boiling points outside the preferred range may also be sufficiently unpolymerizable to function in accordance with the present invention. The preferred heavy petroleum plasticizing material has a viscosity at 210° F. of approximately 19.5 centistokes.

Such a heavy aromatic petroleum oil may be employed as an additive to the coal tar binder to plasticize the taphole mix. While the amount of petroleum oil employed depends in large part on the degree of plasticization desired, it is preferably added in amounts from about 5 to about 11% by weight of tar employed. When added in these levels, the oil modifies the taphole material so that no hardening of the mix in the mud gun nozzle will be experienced during normal application even after 30 minute holds at the furnace taphole.

The coal tar materials employed in the taphole mix composition of the present invention may be any of those materials conventionally employed in the prior art for such applications and their equivalents. Application of the principles of the present invention to binders including additional natural and synthetic binding materials in addition to coal tar which do not substantially interfere with the plasticizing effects of the heavy aromatic petroleum oil are also contemplated.

The refractory fillers which may be used to prepare the plugging compositions of this invention include those generally employed in this art such as clay, alumina, carbon, magnesia, high density silicious sand, chamotte, corundum, dolomite, silicon carbide, bauxite, mullite, sillimanite, etc.

Taphole mixes in accordance with the present invention may also include carbonaceous materials such as coke breeze, soft coal, hard coal, graphite etc.

Processes for making the blast furnace taphole plugging compositions according to the present invention entail (1) the preparation of a plugging mix comprising a coal tar binder and a refractory filler and (2) plasticization of the mix by the addition of a very heavy aromatic petroleum oil which fails to polymerize at the high heating rates experienced during normal application of the taphole mix to the taphole, as above described. The mix may or may not contain suitable additional ingredients. While plasticization may be effected by introduction of the very heavy aromatic petroleum oil at any suitable stage of preparation of the mix, it is preferred that the heavy aromatic petroleum oil be employed as an additive to the coal tar to effect plasticization of the taphole mix.

Processes of using the blast furnace taphole plugging compositions in accordance with the present invention entail (1) introducting a blast furnace taphole plugging composition comprising a coal tar binder, a refractory filler and a very heavy aromatic petroleum oil which fails to polymerize at the high heating rates experienced during normal application of the taphole mix to the taphole, as above defined, into a mud gun or similar apparatus for injecting the plasticized material into a blast furnace taphole or the like; (2) applying the blast furnace taphole plugging composition of the present invention to the taphole via such apparatus; and (3) holding the mud gun or similar apparatus at the furnace taphole for a time sufficient to effect plugging of the taphole. Taphole plugging methods in accordance with the present invention are such that no hardening of the mix in the mud gun nozzle will be experienced during normal application even after 30 minute holds at the furnace taphole.

An example of a soft taphole material in accordance with the present invention appears in Example 1.

EXAMPLE 1

| Composition | Weight, Percent |
|---|---|
| Coke Breeze | 15–40 |
| Fireclay | 15–30 |
| Calcined Fireclay | 10–20 |
| Ball clay | 20–35 |
| Coarse Sand | 5–20 |
| Coal Tar (Added) | 20–30 |
| Heavy Petroleum Oil (Added) | 1.4–2.1 |

It will be apparent to those skilled in the art that various modifications and variations can be made in the blast furnace taphole plugging composition in accordance with the present invention and in the methods by which such compositions may be made and used without departing from the scope or spirit of the invention. Thus, it is intended that the present invention cover the modifications and variations of this invention provided that they come within the scope of the appended claims and their equivalents.

What is claimed is:

1. A process for plugging a blast furnace taphole comprising (1) introducing a blast furnace taphole plugging composition comprising a coal tar binder, a refractory filler and a very heavy aromatic petroleum oil, which fails to polymerize at the high heating rates experienced during normal application of the taphole mix to the taphole, into an apparatus suitable for injecting the mix into a blast furnace taphole, said heavy aromatic petroleum oil having a minimum boiling temperature of 700° F. and above and a boiling range between 700° F. and 1000° F. and being present in an amount from about 5 to about 11% by weight on a coal tar basis; (2) applying said blast furnace taphole plugging composition to the taphole via said apparatus; and (3) holding said apparatus at the furnace taphole for a time sufficient to effect plugging of the taphole.

2. A process for plugging a blast furnace taphole as defined in claim 1, wherein said heavy aromatic petroleum oil is a substituted aromatic petroleum oil.

3. A process for plugging a blast furnace taphole as defined in claims 1 or 2 wherein said aromatic petroleum oil is derived from the distillation of a heavy crude oil stream.

4. A process for plugging a blast furnace taphole as defined in claims 1 or 2 wherein said heavy aromatic petroleum oil is compatible with coal tar.

5. A process for plugging a blast furnace taphole as defined in claims 1 or 2 wherein said heavy aromatic petroleum oil has a viscosity at 210° F. of about 19.5 centistokes.

6. A process for plugging a blast furnace taphole as defined in claims 1 or 2 wherein said heavy aromatic petroleum oil is present in amounts sufficient to prevent hardening of the mix under the conditions experienced in a mud gun nozzle during normal application after 30 minute holds at the furnace taphole.

* * * * *